United States Patent [19]

Shida et al.

[11] 4,433,401

[45] Feb. 21, 1984

[54] ELECTRONIC TIMEPIECE HAVING A STEPPING MOTOR AND DRIVING CIRCUIT COMPENSATED FOR POWER SOURCE VARIATIONS

[75] Inventors: Masaharu Shida; Makoto Ueda, both of Tokyo, Japan

[73] Assignee: Seiko Instruments & Electronics Ltd., Tokyo, Japan

[21] Appl. No.: 168,319

[22] Filed: Jul. 10, 1980

[30] Foreign Application Priority Data

Sep. 18, 1979 [JP] Japan ..... 54-119799

[51] Int. Cl.[3] ..... G04B 9/00

[52] U.S. Cl. ..... 368/204; 368/66; 368/85; 368/217; 368/157; 340/636; 318/696

[58] Field of Search ..... 368/204, 203, 66, 76, 368/80, 85, 86, 87, 155, 157, 160, 217, 218, 219, 228; 318/696; 340/636

[56] References Cited

U.S. PATENT DOCUMENTS

| | | | |
|---|---|---|---|
| 4,107,595 | 8/1978 | Campe | 318/696 |
| 4,140,955 | 2/1979 | Drabing | 318/696 |
| 4,212,156 | 7/1980 | Kawamura et al. | 368/217 X |
| 4,214,434 | 7/1980 | Sutter | 368/80 X |
| 4,254,491 | 3/1981 | Haub et al. | 368/217 X |
| 4,272,837 | 6/1981 | Ueda et al. | 368/85 X |
| 4,295,083 | 10/1981 | Leenhouts | 318/696 |

*Primary Examiner*—B. A. Reynolds
*Assistant Examiner*—Philip H. Leung
*Attorney, Agent, or Firm*—Robert E. Burns; Emmanuel J. Lobato; Bruce L. Adams

[57] ABSTRACT

An electronic timepiece comprising a power source, an electronic circuit, a stepping motor, and a detecting device for detecting a rotor movement after the stepping motor is driven. The electronic circuit includes a power source voltage detecting circuit and driving power controlling device which intermits driving pulses of the stepping motor according to an output of the voltage detecting circuit so that the driving force is substantially constant and the power consumption is decreased.

11 Claims, 20 Drawing Figures

FIG. 5
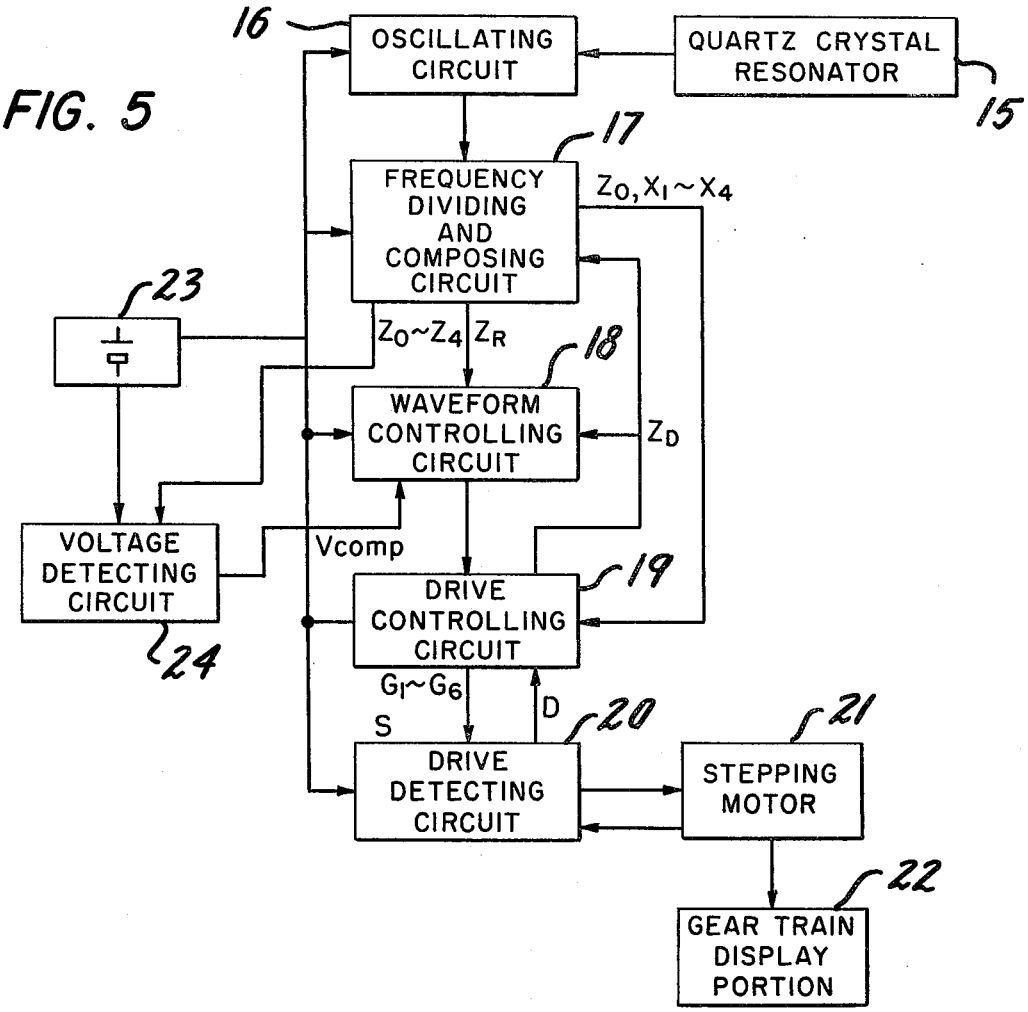
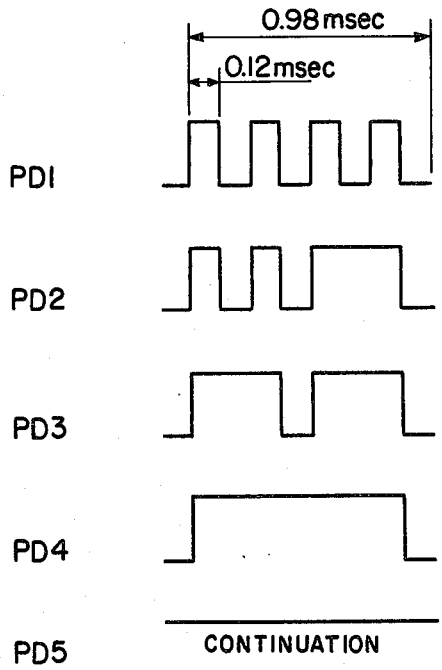
FIG. 7

ELECTRONIC TIMEPIECE HAVING A STEPPING MOTOR AND DRIVING CIRCUIT COMPENSATED FOR POWER SOURCE VARIATIONS

BACKGROUND OF THE INVENTION

The present invention relates to an analogue display electronic timepiece comprising a stepping motor having a rotation detecting means, and more particularly to a driving circuit which enables the stepping motor to operate the rotation detecting means stably even if the voltage and internal resistance of the timepiece power source vary.

Recently, a method to detect rotation of a rotor by some means and feedback to a driving circuit have been invented and put into a practical use. After driving pulses are applied to the stepping motor an induced voltage waveform generated in the motor coil by a free movement of the rotor varies according to rotational conditions of the rotor. This technique for detecting the rotation of the rotor taking advantage of the variation of the motor coil voltage waveform will be illustrated.

FIGS. 1A and 1B respectively show a perspective view of an embodiment of a stepping motor and a driving voltage waveform applied to motor coil 3.

FIG. 2 shows a driving circuit and a rotation detecting circuit of the stepping motor.

FIG. 3 shows a voltage waveform induced at a terminal 12 of a detection resistance in case a closed loop 11 is composed of a circuit path 11 after the stepping motor is driven through a circuit path 10 by controlling a gate.

A waveform (a) shows a voltage waveform in the case the rotor rotates normally and a waveform (b) shows a voltage waveform in the case the rotor does not rotate. The rotation and non-rotation of the rotor is easily discriminated by detecting whether the voltage reaches a fixed value or not, electrically. If batteries of large voltage variation such as a lithium battery and a secondary battery are used as a power source of the electronic timepiece having the above mentioned rotation detecting means, the driving power of the stepping motor varies and as a result the movement of the rotor after the stepping motor is driven is influenced.

FIGS. 4A and 4B respectively show voltage characteristic diagrams of the induced voltage waveforms by the detecting circuit versus the voltage value at a peak P when the rotor rotates and the time interval T in which the induced voltage develops. As shown in the diagrams, it is difficult to realize the rotation detecting circuit which detects the induced voltage waveforms stably, especially in the case space is limited like in wrist watches, since the induced voltage waveforms vary to a large degree in accordance with the voltage.

SUMMARY OF THE INVENTION

Accordingly, it is an object of the present invention to enable the rotor detecting circuit to operate stably by keeping driving power of the stepping motor substantially constant even if the source voltage varies, by overcoming the above mentioned disadvantage.

It is another object of the present invention to provide an electronic timepiece comprising a power source, an electronic circuit, a stepping motor, a detecting device for detecting a rotor movement after the stepping motor is driven, wherein the electronic circuit is provided with a power source voltage detecting circuit and a driving power controlling device which intermits driving pulses of the stepping motor according to an output of the voltage detecting circuit so that the driving force is substantially constant.

BRIEF DESCRIPTION OF DRAWINGS

These and other objects, features and advantages of the invention will become more apparent upon a reading of the following detailed specification and drawing, in which:

FIG. 5 shows a block diagram of the embodiment of the present invention, FIG. 7 shows partial driving voltage waveform of the embodiment.

DETAILED DESCRIPTION OF THE INVENTION

Figure 1A:
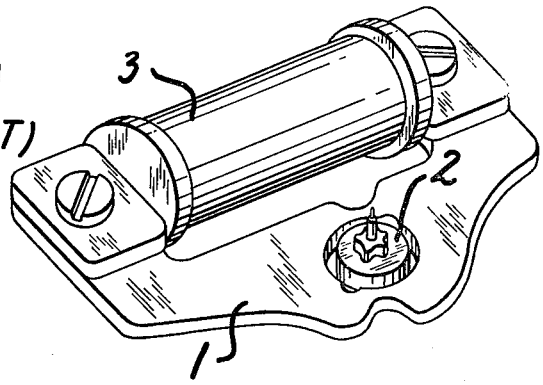
FIG. 1A (PRIOR ART)
FIGS. 1A and 1B show a perspective view of the stepping motor and the driving voltage waveform thereof.
Figure 1B:
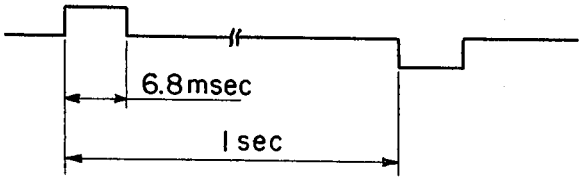
FIG. 1B (PRIOR ART)

Referring first to FIG 5, there is shown a block diagram showing the embodiment of the present invention. Numeral 15 denotes a quartz crystal resonator connected to an oscillating circuit 16 and oscillates at 32,768 Hz. The signal is fed to a frequency dividing and composing circuit 17 and is divided and composed in turn by a flipflop. And the signal necessary for another circuits are produced. A waveform controlling circuit 18 controls the driving voltage waveforms according to the output of the voltage detecting circuit 24. A drive controlling circuit 19 actuates a correction driving operation to be mentioned later. A drive detecting circuit 20 produces a driving pulse applied to a stepping motor 21 and detects the rotation of the rotor. The rotational movement of the stepping motor 21 is transmitted to a gear train display portion 22 and time is displayed.

Figure 6:
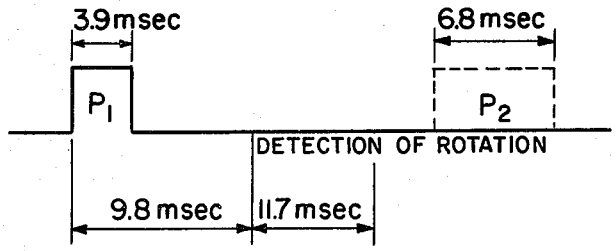
FIG. 6 shows a timing chart of the basic operation of the embodiment.

The correction driving method will be illustrated briefly in conjunction with FIG. 6. The stepping motor is conventionally driven by a fixed pulse of 6.8 msec pulse width. While according to the present driving method, the stepping motor is driven by the normal driving pulse P1 having the shorter pulse width (3.9 msec according to this embodiment). Thereafter, the rotation and non-rotation of the rotor is detected by the voltage waveform induced in the coil and when the non-rotation of the rotor is detected, the rotor is driven again by the correction driving pulse P2 having the longer pulse width (6.8 msec according to this embodiment) without delay. Actually, however, the timepiece can be driven by the normal driving pulse P1, the correction driving pulse P2 is seldom produced. Accordingly, the correction driving method contributes to substantially reduce the power consumption in comparison with the conventional fixed pulse method.

The waveform controlling method of the driving voltage, by detecting the source voltage, will be discussed briefly.

FIG. 7 shows segments of the normal driving voltage waveforms and the correction driving voltage waveforms according to the present method. The waveform is repeated selectively from the waveforms according to the source voltage. As a result the pulse widths of the normal driving pulse is 3.9 msec and the correction driving pulse is 6.8 msec as a whole. As for the waveform in FIG. 7, some parts of the driving pulse are eliminated on the basis of the pulse of 0.12 msec pulse width as one unit. And rates of the effective pulse widths accounting for the overall pulse width varies at 4/8, 5/8, 6/8, 7/8 and 8/8 from PD1 to PD5 respectively. Though the driving pulse applied to the stepping motor is intermittent, the rotor rotates smoothly since the driving power is made smooth by an inductance of the motor coil and a moment of inertia of the rotor. Thus the driving power of the stepping motor is always kept constant by selecting the above driving voltage waveforms according to the source voltage.

Hereinafter the embodiment of the present invention will be described in detail.

Figure 8A:
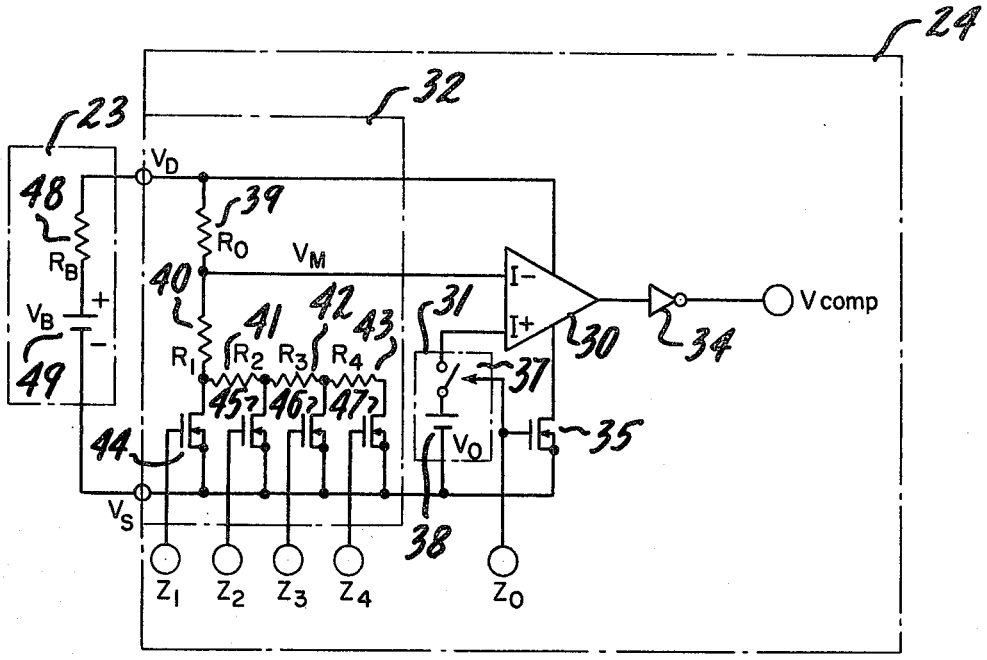
FIGS. 8A, 8B and 8C show the embodiments of constructions of the voltage detecting circuit.

FIG. 8A shows a circuit diagram of the voltage detecting circuit 24 and the power source 23 according to the present invention. Reference numeral 38 denotes a battery, 49 denotes an ideal battery which produces a battery voltage $V_B$, 48 is an internal resistance of the battery. Terminals $V_D$, $V_S$ are terminals of an IC. In FIG. 8A the portion circuit 24 except the battery 38 is a voltage detecting circuit incorporated into the IC.

The voltage detecting circuit consists of three blocks, i.e., a comparator 30, a reference voltage generator 31 and voltage divider 32. The comparator 30 compares the voltages of an input $I^+$ and an input $I^-$ and the output from the comparator 30 is "H" if $I^+ > I^-$. The inverter 34 serves as a buffer of the comparator and at the same time reverses the comparator output. The output from the inverter is Vcomp.

Generally, since the comparator consumes power when it operates, NMOS FET 35 is ON only when $Z_0$ signal is "H".

The reference voltage generator 31 is regarded as a battery of the voltage $V_0$ equivalently. Since an operating current is also necessary for generating the reference voltage, a switch 37 is ON equivalently and the reference voltage generator 31 operates only when $Z_0$ signal is "H".

The reference voltage generator 31 has conventionally been developed for detecting battery life. The battery life is detected using the difference in threshold voltage between a couple of NMOS FETs.

Figure 8B:
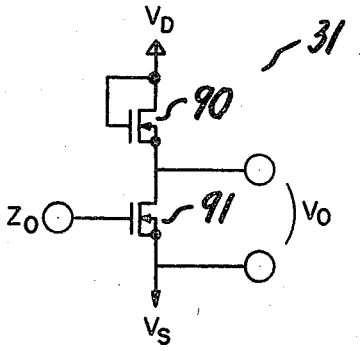

FIG. 8B shows an embodiment of the reference voltage generating circuit construction.

NMOS FET 91 is a threshold voltage $V_{TN}$. NMOS FET 90 is controlled by an ion implantation to serve as a threshold voltage $V_{TN}$ and the output $V_0$ is given by $V_0 = V_{TN} - V'_{TN}$. Although the absolute values of $V_{TN}$ and $V'_{TN}$ vary according to density of the substrate, temperature and the like, the value $V_{TN} - V'_{TN}$ can be controlled by an amount of the ion implantation during the IC manufacturing process. While the switch 37 may operate if the control signal $Z_0$ is applied as it is to the gate of NMOS FET 91.

Subsequently an operation of the voltage divider 32 of the voltage detecting circuit will be illustrated.

If the terminal $Z_1$ is "H", NMOS FET 44 is ON. When $R_B = 0$ and the ON resistance of NMOS FET 44 is 0, $V_{M=VB} \cdot R_1(R_0 + R_1)$. The comparator 30 compares voltages between $V_M$ and $V_0$ and determines the higher one.

In the case the driving voltage varies, the ratio of $R_0$, $R_1$, $R_2$, $R_3$, and $R_4$ can be determined by the following equations when the voltages to be detected are 2.8 V, 2.2 V, 1.9 V and 1.6 V.

$$V_{D1} = 2.8 = (1 + R_0/R_1)V_0$$

$$V_{D2} = 1.9 = \{1 + R_0/(R_1 + R_2)\}V_0$$

$$V_{D3} = 1.9 = \{1 + R_0/(R_1 + R_2 + R_3)\}V_0$$

$$V_{D4} = 1.6 = \{1 + R_0/(R_1 + R_2 + R_3 + R_4)\}V_0$$

In the above equations, $V_0$ can be regarded as a constant value as mentioned above and the resistance ratios of each equation can be set by length ratios of IC patterns. Therefore the temperature characteristic of the detecting voltages $V_{D1}$ to $V_{D4}$ is excellent and the resistance ratio of each equation is not influenced by parameters of the IC manufacturing process, and as a result the $V_D$ values of each equation can be set correctly.

Figure 8C:
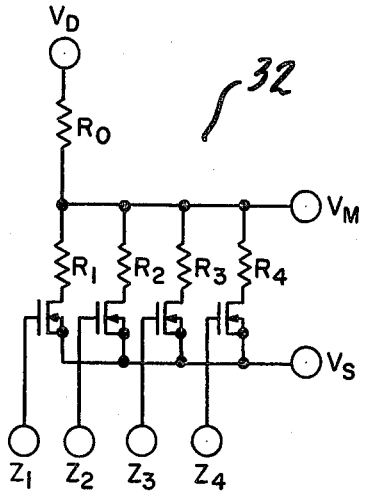

FIG. 8C shows another embodiment of the voltage divider of the power source. The voltage divider of FIG. 8C is the same as the voltage divider in FIG. 8A in operation but different from it in method of setting the resistance.

Figure 9A:
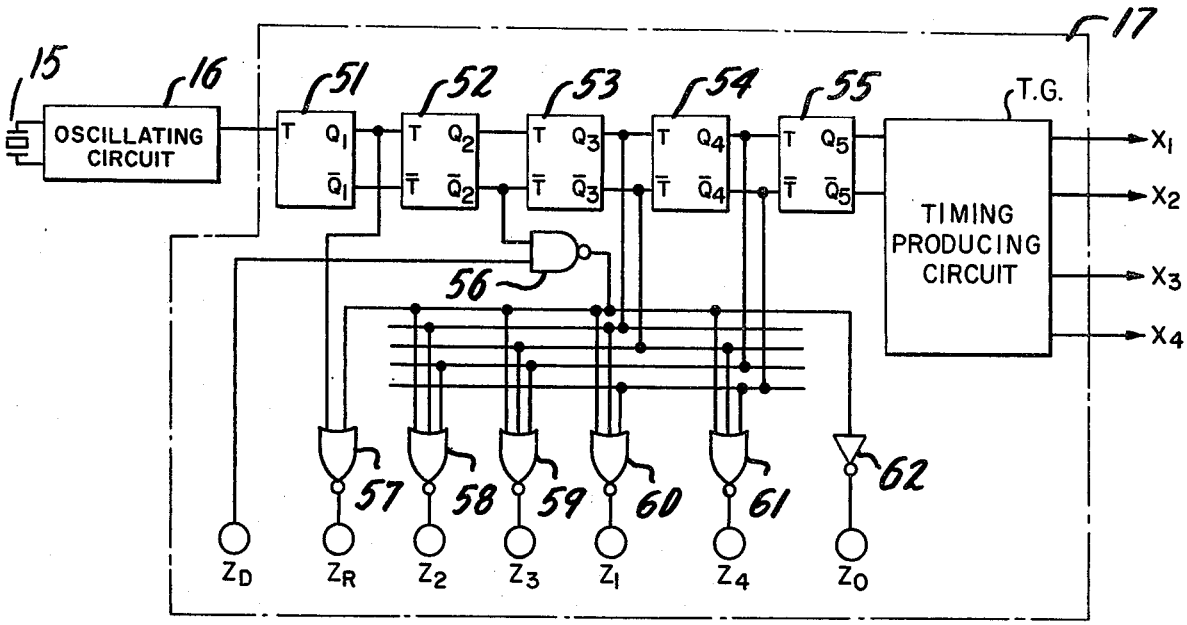
FIGS. 9A and 9B show the embodiment of the construction of the frequency dividing and composing circuit and the timing chart thereof, FIGS. 10A and 10B respectively show the embodiments of constructions of the waveform controlling circuit.
Figure 9B:
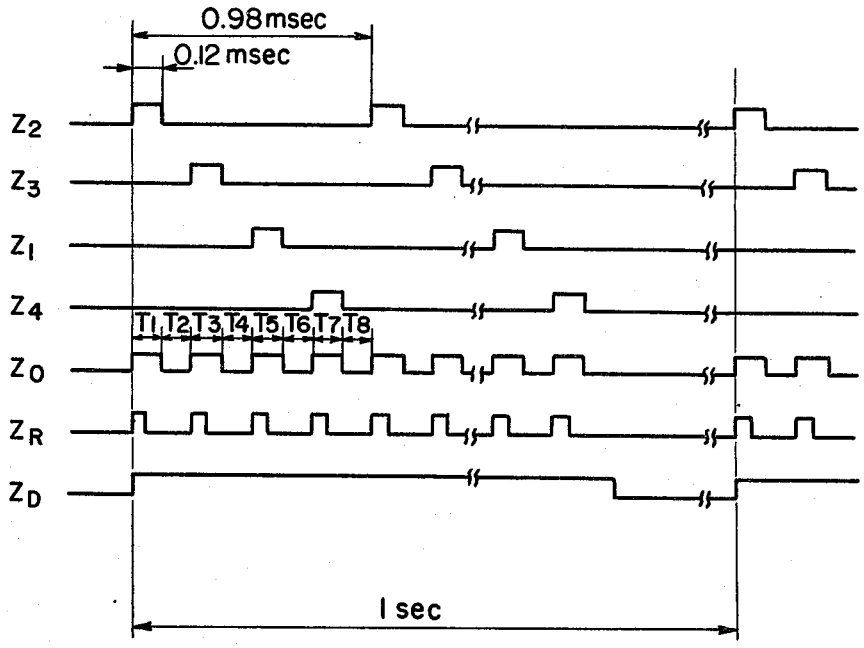

FIGS. 9A and 9B show the frequency dividing and composing circuit 17 which composes the signals necessary for operating the waveform controlling circuit 18 and the drive controlling circuit 19 and the timing chart thereof.

The oscillating circuit 16 produces reference signals of 32,768 Hz using the quartz crystal resonator 15 as the oscillating source. The reference signals are divided in turn by flipflops 51, 52, 53, 54 and 55. The divided signals are composed or combined by gates 56, 57, 58, 59, 60, 61 and 62 and the necessary signals are produced. Additionally a signal of one second period having the pulse width of 6.8 m second composed in another wave shaping circuit is fed to an input terminal $Z_D$ (not shown).

Signals composed in the wave shaping circuit 4 are four phase clock signals $Z_1$, $Z_2$, $Z_3$ and $Z_4$, 8 Kz signal $Z_0$ and 8 KHz signal $Z_R$ in the duty cycle of 1:3. All of these signals are masked by $Z_D$ signals having the pulse width of 6.8 msec at a one second period and produced.

Figure 10A:
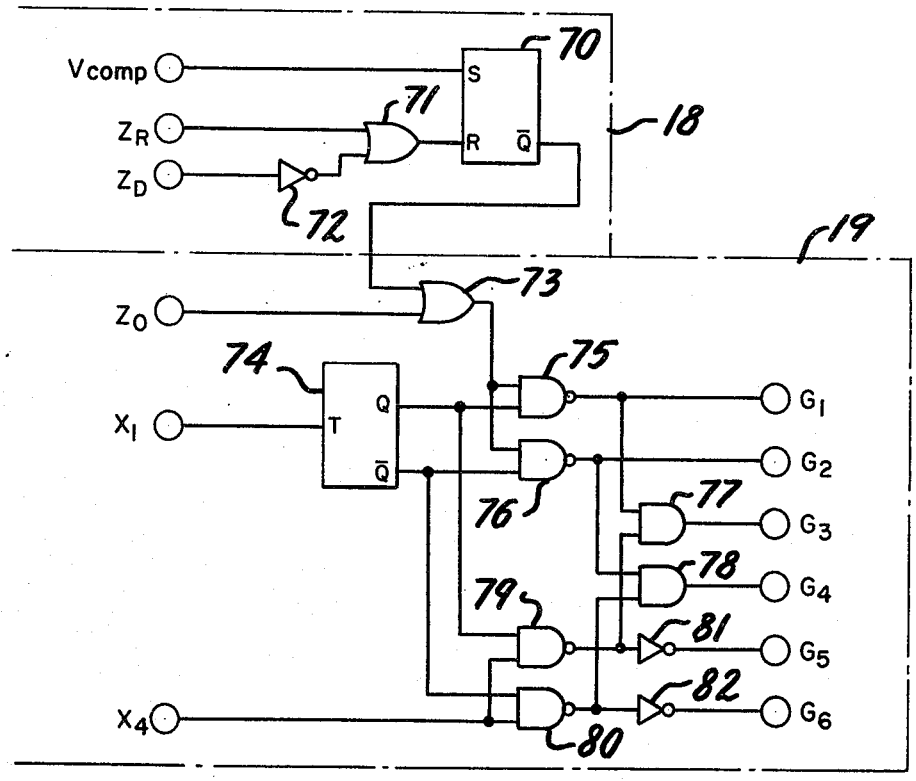
Figure 10B:
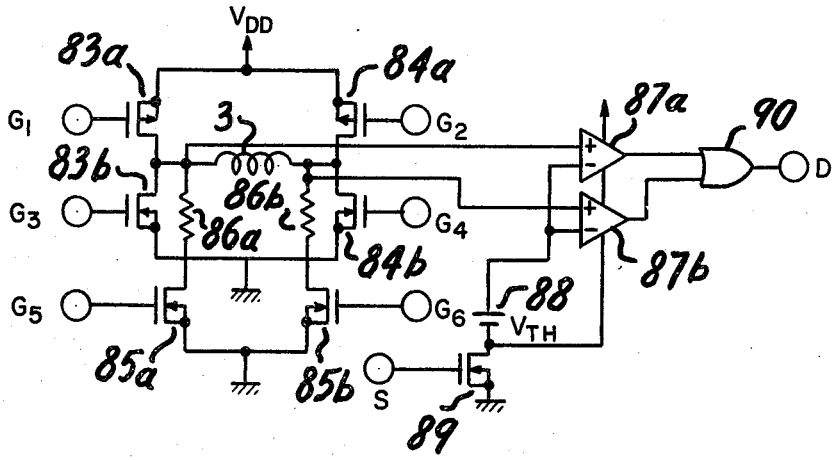
Figure 11A:
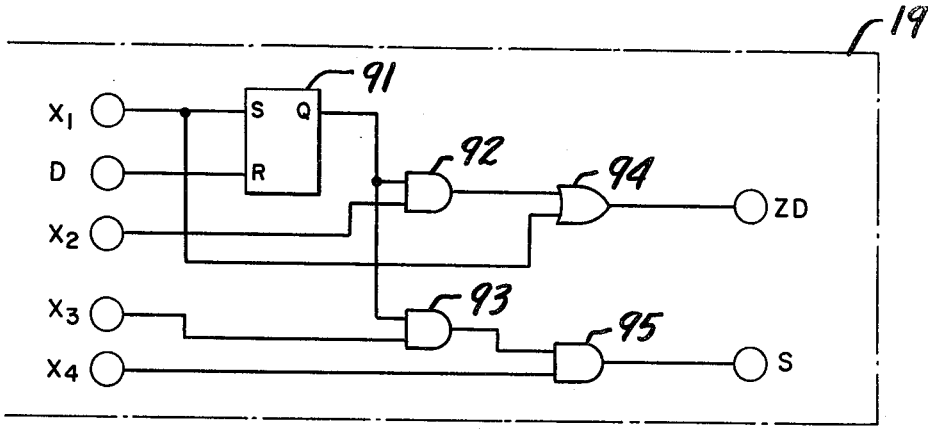
FIGS. 11A and 11B shows the embodiment of the construction of the drive controlling circuit and a timing chart of the basic signals.

FIGS. 10A, 10B and 11A show the waveform controlling circuit 18, the drive controlling circuit 19 and the drive detecting circuit 20.

Figure 11B:
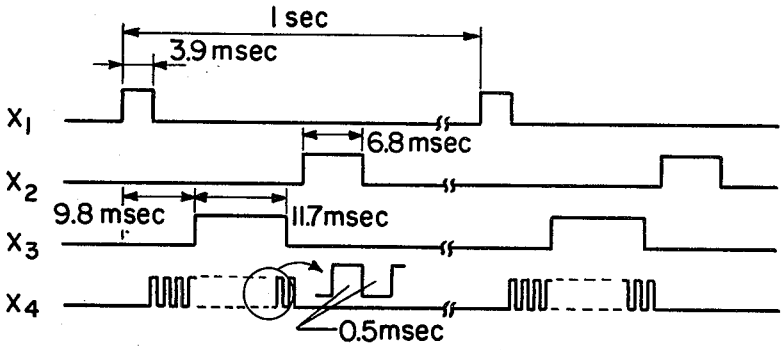

FIG. 11B is a chart showing basic timing signals produced from a timing producing circuit T.G. of the frequency dividing and composing circuit 17 in FIG. 9A. Timing signals $X_1$, $X_2$, $X_3$ and $X_4$ give the timings for the normal driving pulse, the correction driving pulse, the rotation detecting pulse and the sampling for the rotation driving pulse of the stepping motor, respectively.

Now, an overall operation of the present embodiment will be illustrated.

The output from an OR gate 73 (referred to OR hereafter) is "H" by the driving signals $Z_0$ at a time $T_1$ in FIG. 9B and simultaneously, the voltage detection is executed by the $Z_2$ signal. SR-flipflop (referred to SR-FF hereafter) 70 is previously reset by the signal $Z_R$. SR-FF 70 is set when the battery voltage is less than 2.2 V since Vcomp is "H" and the output $\overline{Q}$ is changed from "L" to "H".

As a result the driving voltage waveform is "L" at more than 2.2 V supply voltage and "H" at less than 2.2 V supply voltage at a time $T_2$. Likewise, the driving signals $Z_0$ are produced at times $T_3$, $T_5$ and $T_7$ and the supply voltage is detected in the same way. And the output $\overline{Q}$ of SR-FF 70 at the next timing is "L" when the supply voltages are more than 1.9 V, 2.8 V and 1.6 V and "H" when less than 1.9 V, 2.8 V and 1.6 V. As a result the driving voltage waveforms of OR73 of the drive controlling circuit 19 over 2.8 V, 2.2 V, 1.9 V and 1.6 V and under 1.6 V are as shown by $PD_1$, $PD_2$, $PD_3$, $PD_4$ and $PD_5$ in FIG. 7A in 0.98 msec. The normal driving pulse waveform is completed by repeating the above operation four times during the time interval of 3.9 msec when the signal $X_1$ is fed to $Z_D$ via OR 94.

T-FF74 composing the drive controlling circuit 19 shown in FIG. 10A alternately inverts the outputs by $X_1$ signals fed each second and alternately produces the driving voltage waveforms produced from OR73 to stepping motor drivers 83*a*, 83*b*, 84*a* and 84*b* via NANDs 75, 76 and ANDs 77, 78 so as to excite the coil 3 of the stepping motor. For instance, when Q of T-FF 74 is "H" and the output from OR 73 is "H", the current flows through the routes $V_{DD}$→FET 83a→coil 3→FET 84b→GND and when Q of T-FF74 is "L", the current flows through the routes $V_{DD}$→FET 84a→coil 3→FET 83b→GND.

Figure 2:
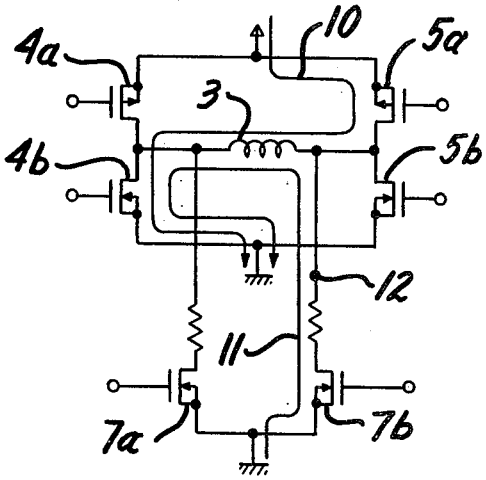
FIG. 2 (PRIOR ART)
FIG. 2 shows the driving circuit and the rotation detecting circuit of the stepping motor.
Figure 3:
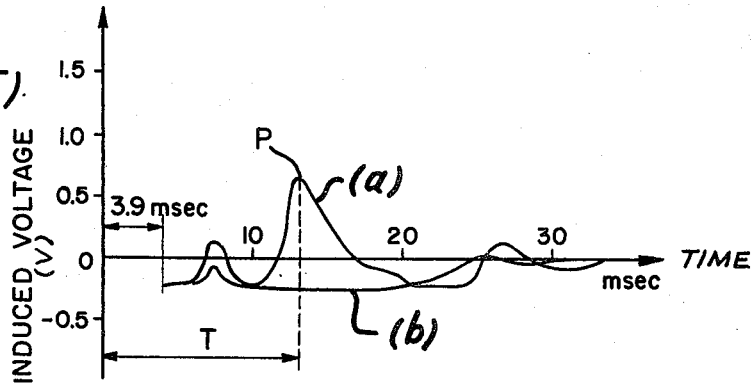
FIG. 3 (PRIOR ART)
FIG. 3 shows the voltage waveforms induced by the rotation of the rotor.
Figure 4A:
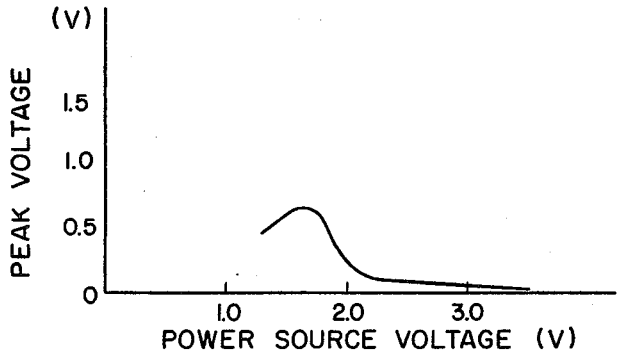
FIGS. 4A and 4B show voltage characteristic diagrams of the induced voltage waveforms.
Figure 4B:
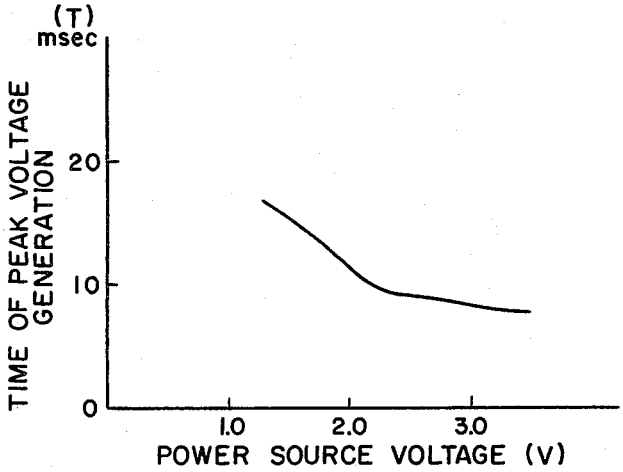
Figure 12A:
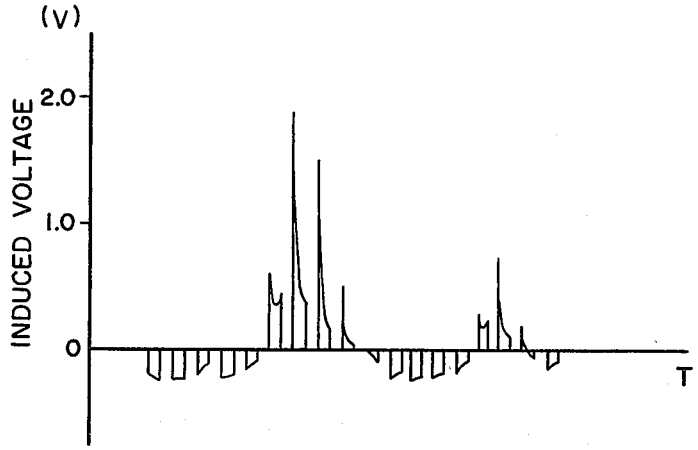
FIGS. 12A and 12B show the induced voltage waveform by the rotation detecting method according to the present invention.
Figure 12B:
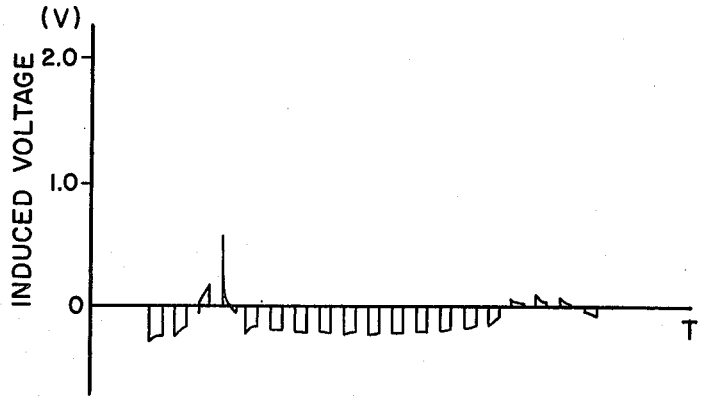

After the normal driving pulses are produced, the sampling for detecting the rotation of the rotor is executed by the signal $X_4$. Though the detection principle of rotation is the same as the principle shown in FIGS. 2 and 3, the signal path 11 and the signal path 10 are changed over by the sampling signal of 1 KHz. Thus an excessive current is produced at an instant the signal path changes over and the induced voltage waveform is increased. The induced voltage waveforms on this occasion will be shown in FIGS. 12A and 12B. FIG. 12A is the induced voltge waveform when the rotor rotates.

The induced voltage developed in this way is fed to comparators 87a and 87b as terminal electrodes of detection resistances 86a and 86b and compared to voltage $V_{TH}$ of a virtual battery 88. As the result a detection output D is "H" when the induced voltage is over $V_{TH}$. The construction of the potential battery 38 is the same as the potential battery 38 shown in FIG. 8A and, to be specific, the circuit as shown in FIG. 8B is used. Further, either the plus input potentials or minus input potentials of the comparators 87a and 87b can be divided in order to regulate the reference voltage $V_{TH}$ finely.

The comparators 87a, 87b and the virtual battery 88 are provided with an N MOS FET 89 which acts as a switch in order to save the wasteful power consumption. N MOS FET 89 operates only when the terminal S is "H".

The rotation detecting output D is connected to the reset input of SR-FF91 in FIG. 11A. SR-FF 91 is set by the signal $X_1$ energy seconds. In the case the rotation of the rotor is detected, i.e., in the case the detection output D is "H", the output Q of SR-FF 91 in FIG. 11A is "L" and the output from the input terminals $Z_D$ and S are prohibited by ANDs 92 and 93. In the case the rotor does not rotate, i.e., in the case D remains at "L", the output Q of SR-FF 91 remains "H" and the signal $X_2$ is fed to $Z_D$ via AND 92 and OR 94. While $Z_D$ remains "H", the driving pulses of the stepping motor are produced and the battery voltage is detected in the same way as in the case the normal driving pulses are produced and the correction driving is executed by the voltage waveform according to the battery voltage.

Now one step drive of the stepping motor is completed. In the next step, the output of T-FF 74 in FIG. 10A is reversed and the coil 3 is excited in the reverse polarity.

According to the present, the rotation of the rotor can be detected by the conventional rotation detecting circuit over a wide range of source voltage and the rotor can be driven with low power consumption. Though the effective pulse rates against the overall pulse width are varied at 4/8, 5/8, 6/8, 7/8 and 8/8 by detecting the voltage at four levels, the rotation of the rotor can be detected under the constant condition up to the higher voltage by varying the effective rates at 1/8, 2/8 and 3/8.

Further, the present invention is effective to drive the stepping motor at a constant output, a constant power consumption and a constant efficiency regardless of the power source. The present embodiment illustrated includes the conventional stepping motor and the rotation detecting circuit for a 1.5 V battery against 3 V battery such as a lithium battery. However, in the case the secondary battery having a charging device using a solar battery is used for the stepping motor and the rotating detecting circuit, the voltage detecting levels may be one or two levels since the voltage variation range is substantially 1.57 to 1.8 V.

What is claimed is:

1. An electronic timepiece, comprising:

a stepping motor having a rotor;

a rotation detection circuit for detecting rotation and non-rotation conditions of said rotor and for developing an output signal indicative of the condition of said rotor;

a power source;

a voltage detecting circuit for detecting the output voltage of said power source and for developing an output signal indicative of the detected output voltage of said power source; and driving control circuit means for generating a pulse driving signal each pulse of which comprises a plurality of sub-pulses and for applying the pulse driving signal to drive said stepping motor, said driving control circuit means comprising means responsive to the output signal of said voltage detecting circuit for determining the effective pulse width of each pulse of said pulse driving signal according to the detected output voltage of said power source, and correction pulse generating means responsive to the output signal of said rotation detection circuit for applying a correction pulse to drive said stepping motor when non-rotation of said rotor is detected by said rotation detection circuit after the application of a driving pulse to said stepping motor.

2. An electronic timepiece as claimed in claim 1, wherein said voltage detecting circuit is effective for detecting the source voltage when said stepping motor is driving.

3. An electronic timepiece as claimed in claim 1, wherein the power source is a lithium battery.

4. An electronic timepiece as claimed in claim 1, wherein said stepping motor has a driving coil and said rotation detection circuit for detecting a rotor movement includes means for detecting an induced voltage induced in said driving coil of the stepping motor by the rotor movement after said stepping motor is driven.

5. An electronic timepiece according to claim 1, wherein said means for determining the effective pulse width is effective to drive said stepping motor at a constant power level.

6. An electronic timepiece according to claim 1, wherein said means for determining the effective pulse width is effective to determine the number of sub-pulses in each pulse of the pulse driving signal.

7. An electronic timepiece according to claim 6, wherein said means for determining the effective pulse width is also effective to determining the width of the sub-pulses in each pulse of the pulse driving signal.

8. An electronic timepiece according to claim 7, wherein said means for determining the effective pulse width is effective to drive said stepping motor at a constant power level.

9. An electronic timepiece according to claim 6, wherein said means for determining the effective pulse width is effective to drive said stepping motor at a constant power level.

10. An electronic timepiece according to claim 1, wherein said means for determining the effective pulse width is effective to determine the width of the sub-pulses in each pulse of the pulse driving signal.

11. An electronic timepiece according to claim 10, wherein said means for determining the effective pulse width is effective to drive said stepping motor at a constant power level.

* * * * *